United States Patent [19]

Julian

[11] 3,967,745

[45] July 6, 1976

[54] SELF-POSITIONING CHILD-RESISTANT CLOSURE

[75] Inventor: Randall K. Julian, Evansville, Ind.

[73] Assignee: Sunbeam Plastics Corporation, Evansville, Ind.

[22] Filed: Aug. 18, 1975

[21] Appl. No.: 605,225

[52] U.S. Cl. ..... 215/216; 215/252; 215/258; 215/365

[51] Int. Cl.[2] ..... B65D 41/34; B65D 41/36; B65D 41/38

[58] Field of Search ..... 215/7, 9, 216, 218, 215/221, 252, 253, 258

[56] References Cited

UNITED STATES PATENTS

| | | | |
|---|---|---|---|
| 3,455,478 | 7/1969 | Fields et al. | 215/252 |
| 3,650,428 | 3/1972 | Miller | 215/252 |
| 3,904,061 | 9/1975 | Keeler | 215/252 |

*Primary Examiner*—George T. Hall
*Attorney, Agent, or Firm*—Henry K. Leonard

[57] ABSTRACT

A child-resistant closure for a liquid container having a threaded neck. The closure comprises an inverted cup-shaped cap which has a shirt and on the inner side of its skirt has a thread that mates with the neck thread. The child-resistant means consists of an outwardly extending ring attached to the end of the skirt by frangible webs. The ring has a gap that is defined by an abutment at one end and a stop at the other end. A tab which permanently is connected to the cap skirt lies in the gap. The cap, ring and tab are unitary and are turned onto the neck to liquid sealing position at which time the ring engages a shoulder formed on the container at or near the base of the neck. The ring is then affixed to the shoulder. The container is opened by flexing the tab upwardly above the level of the abutment on the ring and rotating the cap and tab in a retrograde direction relative to the ring which breaks the frangible webs. When the cap is again rotated onto the container neck until the tab moves into the gap in the ring, the cap is restored to liquid sealing position.

15 Claims, 13 Drawing Figures

SELF-POSITIONING CHILD-RESISTANT CLOSURE

BACKGROUND OF THE INVENTION

This invention relates to improvement in so-called "child-resistant" closures which are becoming more and more necessary in view of the emphasis being placed upon the dangers inherent in the presence in the household of containers of poisonous and harmful substances such as bleaches, detergents, alcohol, antifreeze fluid, drain openers and the like.

Many efforts have been made to provide child-resistant closures. The most successful of these closures have been those which have met the following criteria:

1. The closure and its container must have some cooperating means which require disengagement by an action different from merely unscrewing the cap and this action must require either a separate manipulation in a direction incomprehensible to a small child or the closure must be of such size that a small child cannot successfully grasp it in his hands or between his teeth.

2. The secondary manipulation to enable opening of the closure or removal of the cap must be such that an older child or an adult readily can grasp the significance and perform the necessary manipulation.

3. Preferably, the cap should be of such nature, for example a screw-on type, which can be placed upon the container by conventional capping machinery thus to eliminate the requirement for the purchase of special machinery by producers and fillers of the containers.

4. Preferably, the cap should consist of one piece to reduce the cost by requiring only a single mold in the cap manufacturing plant and to eliminate the labor necessary for the assembly of two-piece caps.

5. Preferably, the neck finish on the container with which the cap is to be used should have a standard thread so that ordinary caps can be placed upon such containers if desirable or to replace the "child-resistant" cap in case that it becomes lost.

6. Preferably, the cap should have threads or other retaining means which will enable it to be used on other containers should that event occur.

One of the principal problems which has been encountered in endeavoring to design child-resistant closures or caps and containers, has been to take into account two variations in the manufacture of both parts. The first of these is the necessary manufacturing tolerances in order that the cooperating means such as the mating threads on the cap and container neck will be functional. The second of these problems arises from the fact that these tolerances may cumulate adversely and either make it impossible for the child-resistant features to be properly aligned when the cap is closed or else to allow the cap to move well beyond its child-resistant position so that the small child can rotate the cap in a retrograde direction up to the child-resistant stop and, many times, cause the entire container to leak its dangerous substance.

Many screw-type caps and container necks have been designed which comprise a radially or downwardly extending tab on the cap itself and an abutment on the neck of the container or on a shoulder of the container adjacent the base of the neck so that, after the cap is screwed onto the container in liquid sealing position, the tab on the cap lies ahead of the abutment on the container so that the child is not able to turn the cap in a retrograde direction beyond the engagement of the tab with the abutment. However, because of the two types of tolerances mentioned above, this frequently results in the necessity for designing the threads and the relative angular positions of the tab on the cap and the abutment on the bottle or container so that when the cap is placed on the container by an automatic capping machine, it will be turned beyond its child-resistant position. In addition, when an older child or an adult restores the cap to the container after first opening, it frequently is turned beyond its child-resistant position.

Because of the pitch of the so-called "standard" threads, which usually are about 6 to the inch, each ten degrees of angular rotation of the cap relative to the bottle neck may result in as much as a variation of 0.005 inch vertically and, if, for example, the cap is turned 40 or 50° beyond the position where the child-resistant elements engage, and the child then turns it back to child-resistant position, the cap may be able to move up and down a substantial distance relative to the neck, and a leaker is almost certain to result.

It is, therefore, the principal object of the instant invention to provide a child-resistant closure for dangerous liquids and the like in which the two cooperating elements of the child-resistant feature automatically are positioned on the cap and container in their child-resistant juxtaposition regardless of whether or not the tolerances mentioned above cumulate in either direction. As a result, when a cap and neck finish embodying the invention are assembled by rotating the cap onto the container neck, the container is sealed against the escape of liquid and will continue to be so sealed every time that the cap is returned onto the neck to the child-resistant position.

It is yet another object of the instant invention to provide a threaded cap for the threaded neck of a container, the cap carrying with it both elements of its child-resistant cooperating means comprising a tab affixed permanently to the cap itself and an abutment which rotates with the cap until the cap is seated on the container in liquid sealing position whereupon the portion of the cap carrying the abutment element of the child-resistant means is permanently fixed to the container by, for examples, ultrasonic or heat sealing or adhesive.

It is yet another object of the instant invention to provide a child-resistant cap which automatically will properly align its cooperating means which render the cap child-resistant regardless of whether or not the tolerances accumulate and which also will be tamper-indicating thus to prevent the cap from being removed off of the container without that fact becoming apparent.

DESCRIPTION OF PREFERRED EMBODIMENTS

Figure 1:
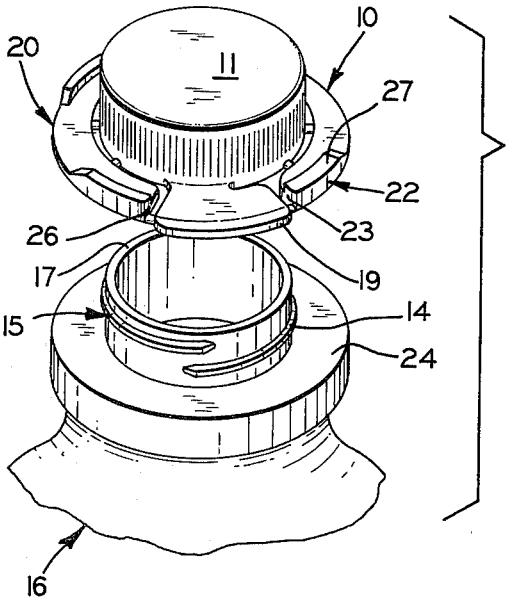
FIG. 1 is an exploded view in perspective showing a cap and container neck embodying the invention prior to the time when the cap is placed upon the container neck and the child-resistant features are finally positioned.
Figure 2:
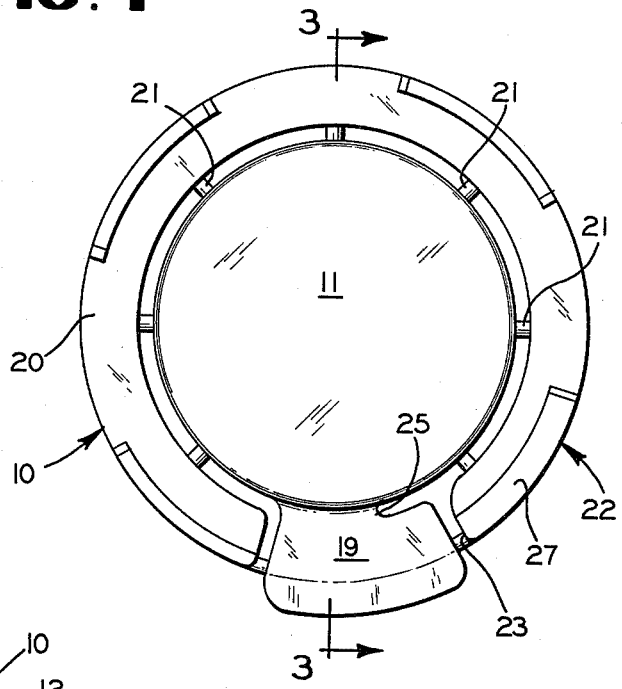
FIG. 2 is a plan view of the cap illustrated in FIG. 1 and shown on a greatly enlarged scale.

A cap generally indicated by the reference No. 10 has a disc-like top 11 and a generally annular skirt 12 depending from the periphery thereof. The cap 10 has a thread 13 formed on the inner surface of its skirt 12 which mates with a thread 14 on the exterior side of a neck 15 of a container fragmentarily indicated by the reference No. 16.

In common with conventional threaded caps and container necks, the cap 10 is threaded onto the neck 15 by rotating it in a clockwise direction when viewed from the top, thereby engaging the two threads 13 and 14 and continuing the rotation until a lip 17 on the neck 15 is sealed by a disc-like liner 18 positioned within the cap 10 adjacent to the under side of its top 11.

Because of the tolerances earlier discussed, it is almost impossible to predict the precise angular relationship of the cap 10 and the container neck 15 when the automatic capping machine with its torque-responsive chuck has completed threading the cap 10 onto the neck 15 or when a person restores the cap 10 onto the neck 15 tightly enough to prevent leakage. In order to obviate the problems which arise from this difficulty, a cap and container neck according to the invention are so designed that the precise angular relationship between the cap and the container neck 15 when the cap reaches sealing position is immaterial.

The cap 10 has a horizontally extending locking tab 19 permanently connected at outer side of end of its skirt 12 and an interrupted ring 20 which also is connected to the outer side of the skirt 12 by a plurality of frangible webs 21. When the cap 10 initially is molded, the tab 19, the frangible webs 21 and the ring 20 are unitary. The ring 20 also has a raised abutment 22 and the abutment 22 has a front vertical face 23.

The container 16 has a generally flat shoulder 24 located beneath the threads 14 a distance such that when the cap 10 is rotated downwardly into sealing position (FIG. 4), at least the outer portions of the ring 20, if not the entire ring 20, will come into contact with the upper surface of the shoulder 24.

Figure 3:
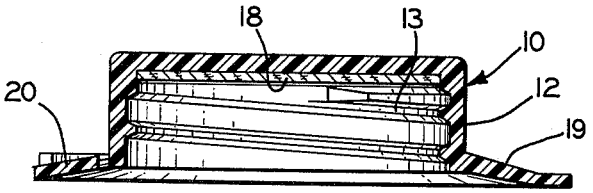
FIG. 3 is a vertical sectional view taken along the line 3–3 of FIG. 2.
Figure 4:
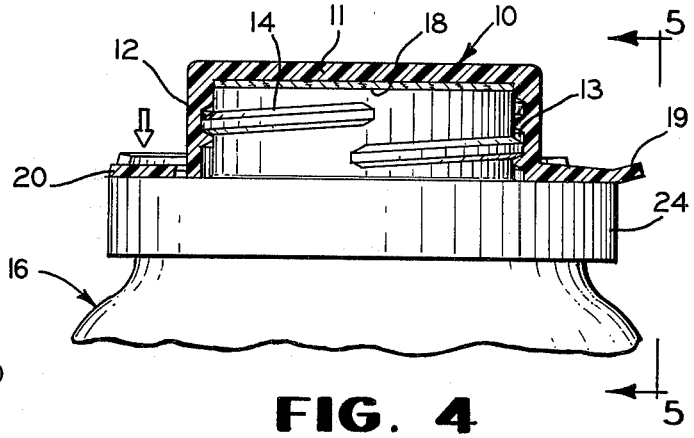
FIG. 4 is a diametric vertical sectional view of the cap and container neck as illustrated in FIG. 1 but showing the cap in final position on the container after its child-resistant element has been adhered or sealed to the container.
Figure 5:
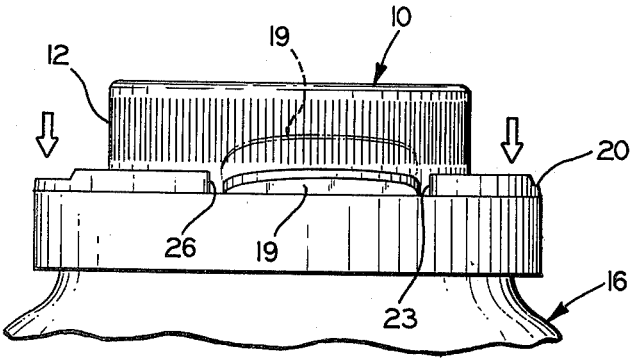
FIG. 5 is a view in side elevation of the cap in child-resistant position on the neck of the container, the view being taken approximately along the line 5—5 of FIG. 4.

It will be noted in FIG. 3 that the ring 20 and the tab 19 extend radially outwardly and downwardly from the cap skirt 12 in what might be called a frusto-conical configuration. As the cap 10 is threaded downwardly onto the neck 15 until it reaches liquid sealing position, the ring 20 and the tab 19 may flex upwardly slightly, bending the reduced portion 25 of the tab 19 and the webs 21, so as to assure firm contact between at least the outer margins of the under surface of the ring 20 with the upper face of the shoulder 24 or, if the tolerances permit, allowing the entire ring 20 to engage the upper surface of the shoulder 24 as illustrated in FIG. 4. After the cap 10 has thus initially been screwed onto the neck 15, the ring 20 is permanently attached to or fixed on the shoulder 24, for examples by sonic welding, heat sealing, adhesion, or other permanent interengagement. This fixing action schematically is illustrated by the arrows in FIGS. 4 and 5, but the particular manner of permanent fixing is not critical to the invention. However, of course, the tab 19 is not sealed or otherwise connected to the shoulder 24.

After the sealing step has been accomplished, the cap 10 is permanently held in place on the container 16 and cannot be removed therefrom without two actions. First, the tab 19 must be bent upwardly to elevate its trailing edge above the abutment face 23 and, secondly, the entire cap and the tab 19 must be rotated in a counter-clockwise direction to break the frangible webs 21. Thereafter, the cap 10 is simply removed from the container in the same fashion as any other threaded cap, i.e., by rotating it in a counter-clockwise direction.

After the desired quantity of the contents have been poured from the container 16, the cap 10 is restored to the container by rotating it again onto the neck 15 until the trailing edge of the child-resistant tab 19 passes the vertical face 23 of the cooperating abutment 22. The cap then is restored to child-resistant ability.

It would also be noted that the ring 20 has a second stop 26 initially positioned just beyond the leading edge of the tab 19 so that when the cap 10 is being turned back onto the container 16, the tab 19 first is elevated by an inclined upper surface 27 of the child-resistant abutment 22 then, by its resiliency, snaps downwardly into the space between the vertical face 23 of the abutment 22 and the second stop 26. Because the positions of the abutment face 23 and second stop 26 have been determined by the cumulated tolerances present in the cap 10 and container neck 15 in the first place, restoration of the cap tab 19 to its position between the abutment 22 and stop 26 insures that the cap once again is in liquid sealing position and that the child-resistant features again are functional.

Figure 6:
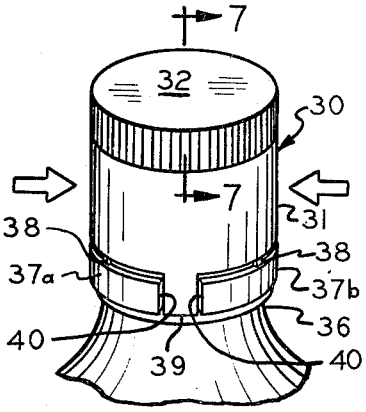
FIG. 6 is a fragmentary view in perspective showing a cap and container neck combination with the cap in place on the container neck.
Figure 7:
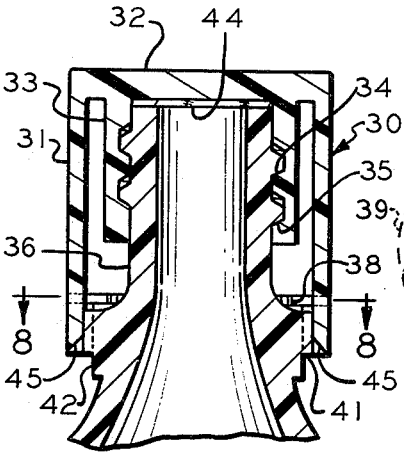
FIG. 7 is a fragmentary vertical sectional view taken along the line 7—7 of FIG. 6 and shown on an enlarged scale.
Figure 8:
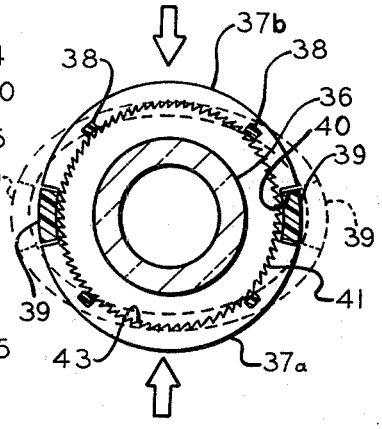
FIG. 8 is a horizontal sectional view taken along the line 8—8 of FIG. 7.

FIGS. 6, 7, and 8 illustrate a second embodiment of the invention and show a cap 30 which has a generally cylindrical outer skirt 31, a disc-like top 32, and an inner skirt 33. The inner skirt 33 has screw threads 34 on its inner wall which mate with threads 35 on the outer side of a container neck 36.

In a fashion somewhat similar to that of the first embodiment of the invention illustrated in FIGS. 1–5, inclusive, an interrupted ring 37 is connected to the lower margin of the cap skirt 31 by a plurality of frangible webs 38 in the initial molding of the cap 30. Two downwardly extending tabs 39 are integrally molded with the cap skirt 31 and fit between spaced ends 40 of the two halves of the ring 37 indicated by the reference Nos. 37*a* and 37*b*.

A series of ratchet-like teeth 41 is formed on the periphery of a shoulder 42 on the bottle neck 36 at such height as to be engaged by a cooperating set of oppositely directed ratchet-like teeth 43 molded on the inner surfaces of the ring halves 37*a* and 37*b*.

As in the first embodiment of the invention, when the cap 30 initially is molded, the interrupted ring 37, the frangible webs 38 and the tabs 40 all are unitary. The cap 30 is screwed downwardly onto the container neck 36 until the torque-responsive chuck tightens it sufficiently to securely seal a liner 44 against the open end of the container neck 36. Prior to this sealing, however, the cooperating sets of ratchet-like teeth 41 and 43 begin to engage each other and the flexibility of the ring halves 37*a* and 37*b*, connected as they are to the cap skirt 31 only by the frangible webs 38, allows the sets of teeth to ratchet over each other until the cap 30 is sealed on the end of the neck 36. Because of the engagement of the cooperating sets of teeth 41 and 43, the cap 30 cannot then be rotated in a retrograde direction (usually counter-clockwise) without disengaging the cooperating sets of ratchet teeth 41 and 43 from each other.

In this embodiment of the invention, disengagement and initial opening of the container is achieved by squeezing inwardly opposite sides of the cap skirt 31 in the direction indicated by the arrows in FIGS. 6 and 8 to bulge the opposite diameter of the skirt 31 outwardly as indicated in FIG. 8 moving the tabs 38 radially outwardly as indicated in the broken line showing in FIG. 8. After the tabs 39 are moved outwardly, the cap 30 can then be rotated relative to the ring 37, breaking the frangible webs 38 and freeing the cap for removal from the container. The cap 30 is restored to sealing position on the container neck 36 again by merely rotating it downwardly to sealing position. As the cap 30 is returned to sealing position, established by the initial relative angular position of the ring 37 and the container neck 36, the tabs 40 first engage the upper margin of the ring 37 and then eventually are rotated around to the position illustrated in FIG. 6 so that, once again, they snap into the space between the ends 40. In order to facilitate the overriding of the tabs 39 as the cap 30 approaches sealing position, the inner surfaces of the two tabs 39 may be bevelled as indicated by the reference No. 45. Conversely, of course, the upper outer edge of the ring 37 might be bevelled so as to deflect the tabs 39 outwardly after engagement and prior to arrival at the locking recess between the ends 40.

Thus this second embodiment of the invention, like the first embodiment of FIGS. 1–5, inclusive, is both tamper-indicating and, by proper selection of the strength of the skirt 31 and its degree of flexibility, also is child-resistant, both intially and after initial removal and restoration.

Figure 9:
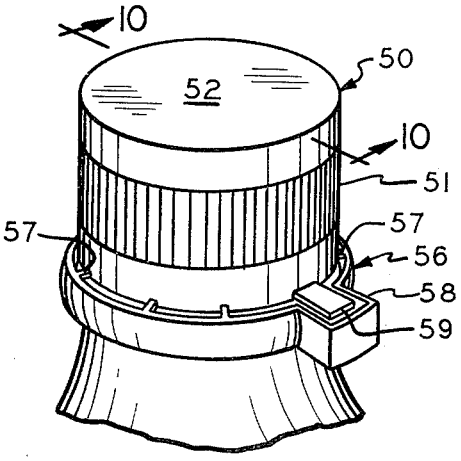
FIG. 9 is a view similar to FIG. 6 but showing a third embodiment of the invention.
Figure 10:
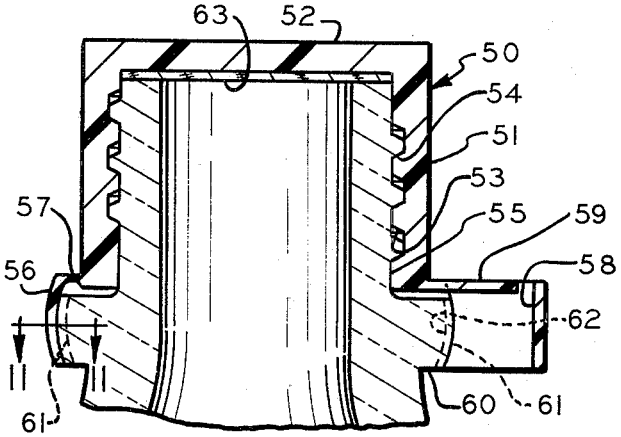
FIG. 10 is a vertical sectional view taken along the line 10—10 of FIG. 9 and shown on an enlarged scale.
Figure 11:
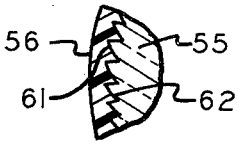
FIG. 11 is a fragmentary horizontal sectional view taken along the line 11—11 of FIG. 10.

A third embodiment of the invention is illustrated in FIGS. 9, 10, and 11. In this embodiment of the invention, a cap 50 has a tubular skirt 51 and a disc-like top 52. The cap 50 has internal threads 53 which mate with threads 54 on a neck 55 of a container. A positioning and retaining ring 56 initially is integrally connected at the lower margin of the cap skirt 51 by a plurality of outwardly extending frangible webs 57. The ring 56 has a radially outwardly extending pocket 58 and there is an outwardly extending tab 59 which is permanently connected to the lower margin of the cap skirt 51 and which initially is molded to extend into the pocket 58.

A shoulder 60 on the container neck 55 has a series of arcuately formed ratchet-like teeth 61 which are engageable by and cooperate with an opposed set of ratchet-like teeth 62 molded on the interior surfaces of the ring 56 which is complementarily arcuately shaped.

When the cap 50 intially is threaded onto the container neck 55, the arcuate configuration of the teeth 61 on the shoulder 60 and the ring 56 causes the lower margin of the ring 56 to be expanded radially outwardly slightly as the teeth 61 – 62 ratchet over each other until the cap 50 reaches sealing position with its linear 63 tightly squeezed against the end of the container neck 55. Continued rotation of the cap 50 finally seats the cap and the resiliency of the ring 56 causes its lower margin to nest in beneath the bulge in the container neck shoulder 60 with the ratchet teeth 61 and 62 fully engaged.

As in the earlier embodiments of the invention, the cap 50 is tamper-indicating until such time as someone lifts the tab 59 above the edge of the pocket 58 and rotates the cap 50 relative to the ring 56 to break the webs 57. The cap 50 may then be unscrewed and access gained to the contents of the container. The cap 50 is restored by merely threading it back onto the container neck 55 until the tab 51 again drops into the pocket 58 whereupon the cap 50 has been restored to sealing position and is child-resistant if the strength of the tab 59, etc. are properly chosen to make it difficult for a small child to comprehend the necessity for bending the tab 59 upwardly in order to free the cap 50 for retrograde rotation. The fracture of the webs 57 is a clear indication to a subsequent person that the container has been opened.

Figure 12:
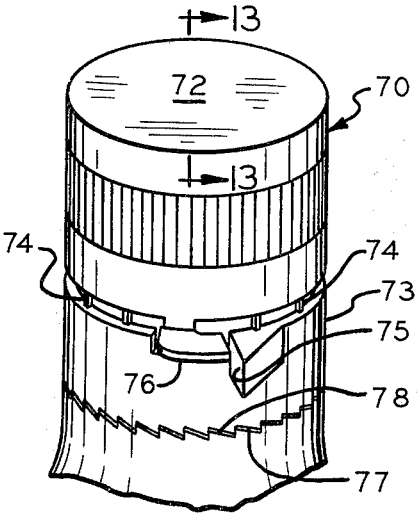
FIG. 12 is a view of a fourth embodiment, similar to FIGS. 6 and 9.
Figure 13:
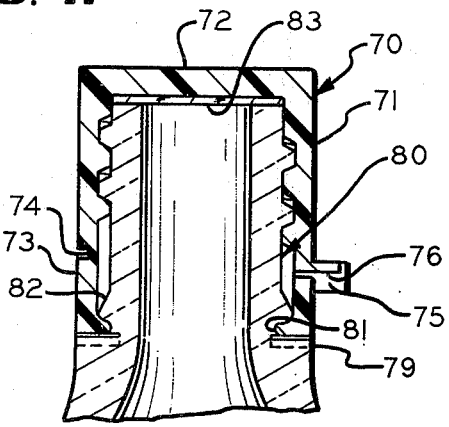
FIG. 13 is a vertical sectional view taken along the line 13—13 of FIG. 12.

A fourth embodiment of the invention is illustrated in FIGS. 12 and 13, inclusive. In this embodiment a cap 70 has a skirt 71 and a disc-like top 72. The cap 70 initially is molded integrally with a retainer ring 73 and connected thereto by vertically extending frangible webs 74. The ring 73 has an abutment 75 adjacent the initial position of the trailing edge of a tab 76 connected to and molded integrally with the lower margin of the cap skirt 71. In this embodiment of the invention, the lower edge of the ring 73 has a series of ratchet-like teeth 77 which cooperate with opposed, similar ratchet-like teeth 78 formed on a shoulder 79 on a container neck 80. In addition, the lower margin of the ring 73 has an inwardly extending annular lip 81 which snaps in beneath an outwardly extending rib 82 on the container neck 80 at a position just above its shoulder 79.

Again, the cap 70, ring 73 and tab 76 all are molded integrally so that the entire combination can be screwed downwardly onto the container neck 80 to a sealing position in which a liner 83 is tightly pressed against the open end of the container neck 80 to seal its contents. The sizes, shapes, etc. of the various component parts are so selected that when the container is sealed by engagement of the liner 83 against the open end of the container neck 80, the sets of ratchet-like teeth 77 – 78 are cooperatively engaged to prevent retrograde rotation of the ring 73 and cap 70 until after the frangible webs 74 initially have been broken.

Thus, as in the earlier described embodiments of the invention, this embodiment also is tamper-indicating. In addition, of course, each time that the cap 70 is returned to the position illustrated in FIG. 12 where the tab 76 engages behind the abutment 75, the cap 70 is returned to sealing position. By proper selection of the degree of flexibility of the tab 76 the cap also remains child-resistant even after initial opening and restoration.

In both the embodiment illustrated in FIGS. 9–11, inclusive, and that illustrated in FIGS. 12 and 13, the respective ring 56 or 73 is permanently retained on the neck of the container in each case by reason of the snap-over action of the arcuate shape of the container shoulder 60 and the ring 56 in cooperation or by cooperation between the lip 81 on the ring 73 and the rib 82 on the container neck 80, as the case may be. Such a "snap-over" arrangement may be very desirable in that it eliminates the necessity for otherwise adhering or fixing the sealing ring in place on the container neck when it is first positioned thereon upon initial closing of the container.

Having described my invention, I claim:

1. A child-resistant closure for the threaded neck of a container, said closure comprising, in combination, a. an inverted cup-shaped cap having a disc-like top and a depending annular skirt, b. a thread on the interior of said cap which mates with the thread on the container neck, c. a tab integrally formed with and at the margin of said skirt, d. a retaining ring integrally formed with and at the margin of said skirt, said ring being attached to said skirt by frangible elements and having a stop adjacent to and aligned with the trailing edge of said tab, and e. a shoulder on the container neck adapted to be engaged by said retaining ring when said cap is rotated onto said neck to sealing position, said ring being fixed to said shoulder and said cap being rotatable in retrograde direction relative to said ring and said container neck only after displacement of said tab to a position removed from alignment with said stop.

2. A closure according to claim 1 in which the ring and the shoulder have surfaces which engage when the cap is rotated onto the container neck to closed position and are adapted to be sealed to each other.

3. A closure according to claim 1 in which the ring and the shoulder have cooperating engageable means for retaining said ring against retrograde rotation relative to said container neck.

4. A closure according to claim 3 in which the engageable means are sets of cooperating opposed ratchet-like teeth formed on the ring and the container neck, respectively.

5. A closure according to claim 1 in which the cap has two concentric skirts, the threads being formed on the inner surface of the inner skirt and the tab and ring being connected to the margin of the outer skirt.

6. A closure according to claim 1 in which the cap skirt and container neck have cooperating rib and lip means for snap-over engagement when the cap reaches closed position on the container neck.

7. A self-positioning child-resistant closure for a container having a threaded neck and a shoulder located on said neck at a level below the thread thereon, said closure comprising a cap having a. a closed top and an annular skirt depending therefrom, b. a tab on the lower end of said skirt, c. a circumferentially extending retainer adapted to engage said shoulder when said cap is threaded onto said neck into sealing position and to be fixed to said shoulder, d. frangible elements initially connecting said retainer to said cap for rotation therewith into sealing position, said elements being broken by rotation of said cap relative to said retainer, and e. means on said retainer engageable by said tab for preventing rotation of said cap and said tab relative to said retainer, said tab being disengageable from said means by movement thereof out of alignment therewith.

8. A closure according to claim 7 in which the retainer is an annular ring-like member located at the lower end of the cap skirt and having a gap therein that is defined by spaced radially extending walls and the tab extends into the gap between said walls.

9. A closure according to claim 7 in which the shoulder has an upper surface lying in a plane normal to the axis of the container neck that is engaged by the retainer ring.

10. A child-resistant closure for a container having a threaded neck, said closure comprising a screw-type cap, a tab extending therefrom, an abutment fixably positionable on said container in alignment for engagement by said tab when retrograde rotation of said cap relative to said container is attempted, said tab being displaceable for disengagement from said abutment, said abutment initially being integrally connected to said cap adjacent the retrograde side of said tab by frangible means and being fixed to said container when said cap initially is rotated onto said container into sealing position.

11. A closure according to claim 10 in which there is an inwardly directed lip at the lower end of the cap skirt and a rib on the container neck beneath which said lip resiliently engages when the cap reaches sealing position.

12. A closure according to claim 10 and cooperating sets of ratchet-like teeth on the cap skirt and the container neck for resisting retrograde rotation of the cap relative to said container neck.

13. A closure according to claim 10 in which the abutment is a part of a ring-like member extending circumferentially substantially around the cap and defining a gap adjacent the outer side of the cap and the tab initially and in child-resistant position extends into such gap.

14. A closure according to claim 13 in which the ring-like member extends axially from the cap skirt and has two separate circumferentially spaced segment-like parts and there are two tabs on the skirt, one of said tabs extending into each of the spaces between the proximate edges of the parts of said ring-like member.

15. A closure according to claim 10 for a container fabricated from a thermoplastic material and the cap and ring-like member are fabricated from a material fusible to said container.

* * * * *